United States Patent [19]

Cave et al.

[11] 4,352,056

[45] Sep. 28, 1982

[54] SOLID-STATE VOLTAGE REFERENCE PROVIDING A REGULATED VOLTAGE HAVING A HIGH MAGNITUDE

[75] Inventors: David L. Cave, Tempe; Steven L. Harris, Mesa; Don W. Zobel, Tempe, all of Ariz.

[73] Assignee: Motorola, Inc., Del.

[21] Appl. No.: 220,207

[22] Filed: Dec. 24, 1980

[51] Int. Cl.[3] ..... G05F 3/18

[52] U.S. Cl. ..... 323/314; 323/231; 323/907

[58] Field of Search ..... 323/311-316, 323/907, 231; 307/310, 318; 330/297

[56] References Cited

U.S. PATENT DOCUMENTS

| | | | |
|---|---|---|---|
| 3,887,863 | 6/1975 | Brokaw | 323/314 |
| 3,997,802 | 12/1976 | Hoehn | 307/310 |
| 4,249,123 | 2/1981 | Kwan | 323/314 |
| 4,313,083 | 1/1982 | Gilbert et al. | 323/907 |
| 4,315,209 | 2/1982 | Schmoock | 323/907 |

OTHER PUBLICATIONS

Analog Dialogue 9-1, pp. 6-8, 1975.

IBM Technical Disclosure Bulletin, vol. 19, No. 10, pp. 3782-3783, Mar. 1977.

*Primary Examiner*—William H. Beha, Jr.

*Attorney, Agent, or Firm*—Vincent B. Ingrassia

[57] ABSTRACT

A two transistor voltage reference circuit controls the ratio of the current densities of two transistors by a negative feedback loop. A voltage corresponding to the difference in the base-to-emitter voltages of the two transistors is developed which has a positive temperature coefficient (TC) and which is connected in series with the base-to-emitter voltage of one of the two transistors having a negative TC. The circuit parameters are selected so that the resultant combined voltage has a predetermined, composite TC. A zener diode is included in the negative feedback loop and arranged to have a TC which cancels the predetermined composite TC to develop a reference voltage having a high magnitude that has minimal variation with temperature change.

12 Claims, 2 Drawing Figures

SOLID-STATE VOLTAGE REFERENCE PROVIDING A REGULATED VOLTAGE HAVING A HIGH MAGNITUDE

BACKGROUND OF THE INVENTION

1. Field of the Invention

This invention relates to regulated, direct current (dc) voltage supplies. More particularly, this invention relates to solid-state, voltage references capable of maintaining dc output voltages each having a high, substantially constant magnitude in the presence of ambient temperature variations.

2. Description of the Prior Art

Some solid-state voltage regulators include internal voltage reference sources and error amplifiers which compare portions of regulated dc output voltages with the output voltages of the reference sources. The reference sources of some regulators rely on the temperature-dependent characteristics of the base-to-emitter voltage ($V_{BE}$) of a transistor. For instance, U.S. Pat. No. 3,617,859 of Robert C. Dobkin et al, discloses a reference source which includes a diode-connected transistor operated at one current density and a second transistor operated at a different current density. These two transistors are interconnected with associated circuitry so as to develop a voltage proportional to the difference in their respective base-to-emitter voltages ($\Delta V_{BE}$). This difference voltage, which has a positive temperature coefficient (TC), is connected in series with the $V_{BE}$ of a third transistor, which has a negative TC. This resulting structure produced a composite voltage at the output terminal of the reference source. Since the temperature coefficients of the two individual voltages are of opposite sign, the output voltage can be made relatively insensitive to temperature variations by proper choice of circuit parameters. Such circuits have disadvantages relating to the facts that they require at least three precisely matched transistors and produce regulated output voltages equal only to the bandgap voltage of about 1.205 volts or multiples thereof.

U.S. Pat. No. 3,887,863 of Adrian Paul Brokaw, discloses a two transistor voltage reference source wherein the ratio of current densities of the two transistors is automatically controlled to a predetermined value by a nagative feedback amplifier. A voltage having a positive TC corresponding to the $\Delta V_{BE}$ of the two transistors is developed and connected in series with the $V_{BE}$ voltage of one of the two transistors having a negative TC. The circuit parameters are selected so that the composite output voltage has a low or minimal temperature coefficient. A voltage dividing network comprising two series-connected resistors may be connected to the output terminal of the negative feedback amplifier. The common junction between these resistors provides a reference voltage which is a predetermined fraction of the output voltage. Therefore, the resulting output voltage is a predetermined multiple of the reference voltage.

Although the foregoing circuit of the U.S. Pat. No. 3,887,863 operates satisfactorily for many applications, it does not always operate satisfactorily when required to provide a high level output voltage approximately equal to several bandgap voltages. For example, one industry standard voltage regulator (MC1723) is specified to have an output voltage of 7.15 volts. The multiplication of error signals within simpler versions of the reference circuit of U.S. Pat. No. 3,887,863 provides unacceptable temperature drifts in the regulated output voltage. Other versions of the circuitry of the U.S. Pat. No. 3,887,863 are too complex for some applications.

Other voltage regulators have utilized a zener diode and a transistor junction in series to provide a desired regulated, reference voltage level. If the output voltage is to be centered at a nominal 7.15 volts, the zener diode breakdown voltage must be selected to be 6.47 volts. The positive TC of a 6.47 volt zener commonly used in monolithic integrated circuit structures is about 2.75 millivolts per degree C. but the negative TC of VBE of the transistor is only about 2.2 millivolts per degree C. Thus the composite output voltage has a TC of about 0.55 millivolts per degree C. or 0.008%/°C. This undesirable TC when added to other TC's of the output voltage caused by other circuitry causes the composite TC of the output voltage to be outside of acceptable specifications for the MC1723. Also, a zener diode having a breakdown voltage of 6.47 volts is difficult to process and it exhibits voltage drift with time caused by surface effects.

OBJECTS OF THE INVENTION

It is therefore an object of the present invention to provide novel, general purpose voltage reference sources having relatively simple configurations for providing regulated voltages which have relatively higher magnitudes which are relatively temperature independent as compared to prior art voltage reference circuits.

Another object of the present invention is to provide a high voltage, temperature stable reference source suitable for being fabricated in monolithic integrated circuit form.

SUMMARY OF THE INVENTION

One embodiment of the present invention is a two transistor voltage regulator or reference circuit wherein the ratio of current densities of the two transistors is automatically controlled by a negative feedback loop. A voltage corresponding to the difference in the base-to-emitter voltages of the two transistors is developed which has a positive TC. This voltage is connected in series with the base-to-emitter voltage of one of the two transistors having a negative TC. The circuit parameters are selected to that the resultant combined voltage has a predetermined composite TC. A zener diode is included in the negative feedback loop and arranged to have a TC which is cancelled by the predetermined composite TC so that the magnitude of the output voltage has minimal variation with temperature. The zener diode also facilitates an output voltage of a relatively higher magnitude than is obtainable with most simple prior art regulator circuits providing relatively low temperature coefficients.

DESCRIPTION OF THE PREFERRED EMBODIMENT

Figure 1:
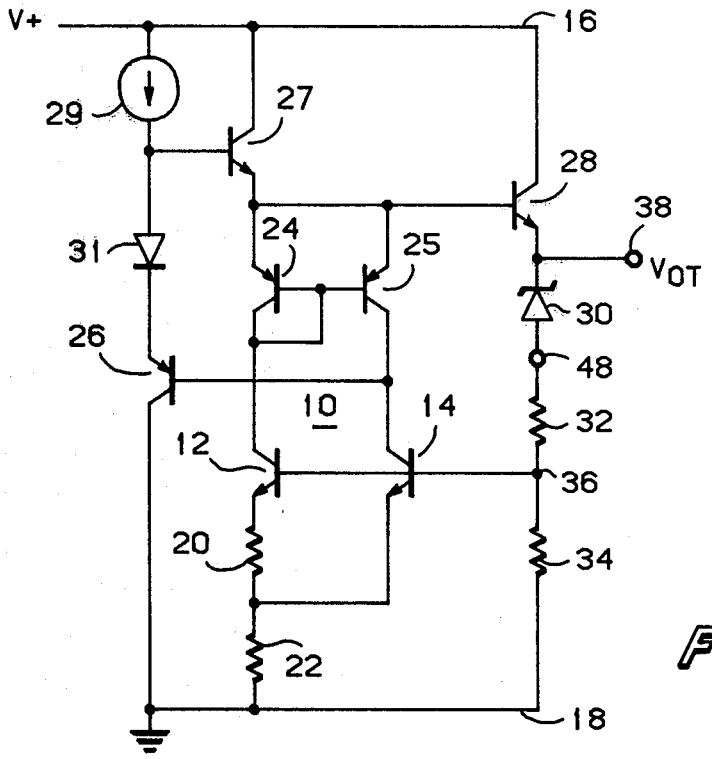
FIG. 1 is a circuit diagram of one embodiment of the present invention.

In FIG. 1 there is shown a circuit diagram of a regulated reference voltage source 10 in accordance with the present invention. The circuit includes a pair of NPN transistors 12 and 14 having emitter, base and collector electrodes which are supplied with operating voltages and currents from positive and negative voltage supply conductors 16 and 18. The emitter electrode of transistor 12 is coupled through two series connected resistors 20 and 22 to the negative voltage supply conductor 18 and the emitter electrode of transistor 14 is coupled through resistor 22 to conductor 18.

Transistors 12 and 14 are operated at different emitter current densities to produce a voltage proportional to the difference in the two transistor base-to-emitter voltages referred to as $\Delta V_{BE}$. More specifically, transistor 14 is operated at a larger current density than transistor 12. There are many ways of creating unequal current densities, but one common way is to scale the emitters of transistors 12 and 14 where the area of the emitter of transistor 12 is some multiple N of the area of transistor 14, with N being greater than 1. To facilitate layout N is usually equal to 8.

The magnitudes of the currents through transistors 12 and 14 are forced to be equal by the negative feedback arrangement, including transistors 24, 25, 26, 27, 28, current source 29 and diode 31. The collector electrode of PNP current mirror transistor 24 is connected to the collector electrode of transistor 12 and the collector electrode of PNP current mirror transistor 25 is connected to the collector electrode of transistor 14 and to the base electrode of PNP level shifting transistor 26. The emitter and collector electrodes of transistor 26 are connected in a series circuit with current source 29, between positive supply conductor 16 and negative supply conductor 18. Level shifting NPN transistor 27 has a base electrode connected to the output terminal of current source 29, a collector electrode connected to conductor 16 and an emitter electrode connected to the base of NPN negative feedback amplifier transistor 28. The emitters of transistors 24 and 25 are also connected to the base electrode of transistor 28. The emitter electrode of transistor 28 is coupled in series with zener diode 30, resistor 32, resistor 34 and negative supply conductor 18. Node 36 between voltage divider resistors 32 and 34 is connected to the common-base electrodes of transistors 12 and 14.

The negative feedback loop enables the magnitudes of the emitter currents of transistors 12 and 14 to be equal by regulating the voltage at node 36. More specifically, if the voltage at the commonly connected bases of transistors 12 and 14 becomes too small, then the voltage drop across resistor 20 becomes too small. The larger emitter area of transistor 12 causes it to conduct more of the total current through resistor 22 than transistor 14. As a result, the collector currents of transistors 12 and 24 are increased. Thus, current mirror transistor 25 is also rendered more conductive which tends to render transistor 26 less conductive. As a result, transistor 27 is then rendered more conductive because more of the current from source 29 is provided to drive the base thereof. Accordingly, transistor 28 is then rendered more conductive which provides a current of increased magnitude through zener diode 30 and resistor 32 to increase the voltage across resistor 34. Thus transistors 12 and 14 are then rendered equally more conductive.

Alternatively, if the base voltages of transistors 12 and 14 become too high, then the current through resistor 22 is increased which increases the voltage across resistor 22. This voltage will tend to render transistor 12 less conductive thereby resulting in current mirror transistors 24 and 25 becoming less conductive, transistor 26 becoming more conductive, and transistors 27 and 28 becoming less conductive to reduce the base drive for transistors 12 and 14. Thus, the negative feedback loop tends to stabilize the magnitude of the voltage at terminal 36 which, along with current mirror transistors 24 and 25, causes the magnitudes of the collector currents of transistors 12 and 14 to be equal. By using well-matched transistors 12 and 14, the magnitudes of the emitter and base currents thereof are also equal.

As previously mentioned transistors 12 and 14 have equal emitter currents and different emitter-base junction areas which causes a difference voltage $\Delta V_{BE}$ to be developed across emitter resistor 20. The current through resistor 20 is directly proportional to $\Delta V_{BE}$. Series connected resistor 22 conducts the emitter currents of both transistors 12 and 14. Thus the current through resistor 20 and hence the voltage across the resistor 20 also will be directly proportional to $\Delta V_{BE}$.

More specifically, it is well known that, for two transistors, e.g. transistor 12 and 14, operating at different current densities, the difference in base-to-emitter voltage is given by:

$$\Delta V_{BE} = kT/q \ln J_1/J_2$$

where

T = absolute temperature, k = Boltzman's constant, q = charge of an electron, $J_1/J_2$ = ratio of the transistor current densities.

Accordingly, the voltage developed across resistor 20 is independent of the actual emitter current and is a linear function of absolute temperature, T with a positive temperature coefficient. Since the currents in transistors 12 and 14 are equal, the current in resistor 22 is twice that in resistor 20 and the voltage, $V_{R22}$ across resistor 22 is given by:

$$V_{R22} = 2(R_{22}/R_{20})\, k\, T/q \ln J_{14}/J_{12}$$

where $J_{12}$ and $J_{14}$ are the current densities of transistors 12 and 14, respectively.

Assuming that the resistor ratio and current density are constant, the voltage across resistor 22 varies directly with T, the absolute temperature and has a positive TC. The voltage at node 36 equals the sum of the base-to-emitter voltage of transistor 14 and the voltage across resistor 22. Since the $V_{BE}$ of transistor 14 has a negative temperature coefficient and the voltage across resistor 22 has a positive coefficient, it is possible to provide a voltage having either a positive, negative, or substantially zero temperature coefficient at node 36 by selecting the values of any or all of resistors 20 and 22. If a voltage having a predetermined TC is provided at terminal 48 then zener diode 30 or some other circuit or component having the opposite TC is utilized in the negative feedback loop to cancel the predetermined TC or the TC of the voltage at terminal 48 can be arranged to cancel the TC provided by zener 30, for instance.

Node 36 between resistors 32 and 34 provides a voltage which is a predetermined fraction of the voltage at output terminal 38. The magnitude of the voltage at node 36 can be set to be optimum for achieving a predetermined temperature coefficient. The output voltage at terminal 38 then will be some predetermined multiple of the voltage at node 36 depending on the relative resistance of resistors 32 and 34 plus the voltage across zener diode 30.

Figure 2:
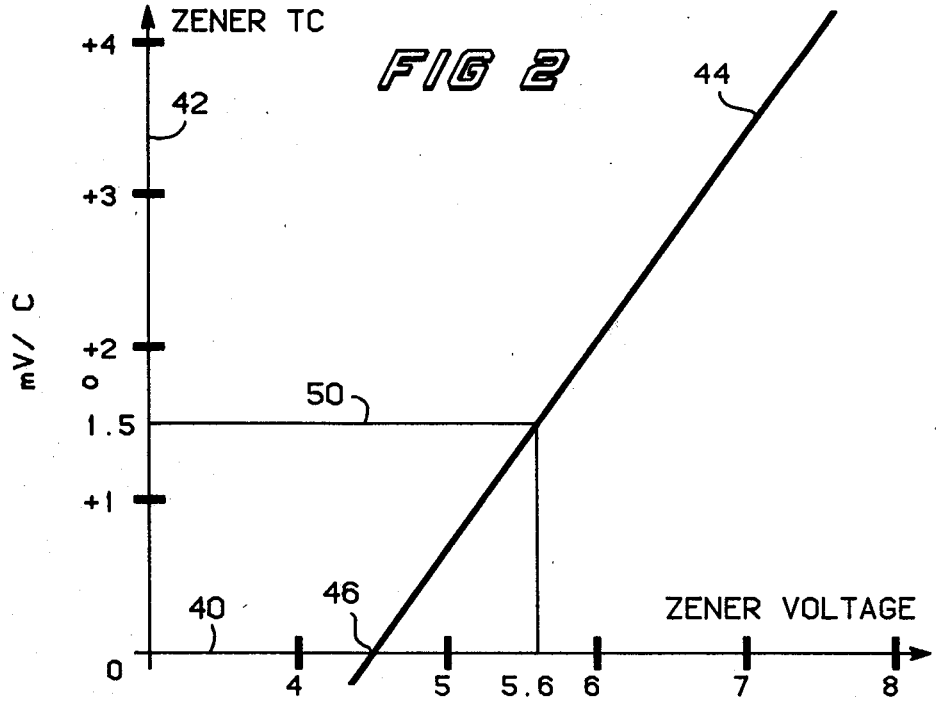
FIG. 2 is a graph of the TC for a monolithic integrated circuit zener diode versus zener voltage.

FIG. 2 shows a typical monolithic integrated circuit zener TC characteristic, with zener voltage plotted along abscissa axis 40 and zener TC plotted along ordinate axis 42. Characteristic 44 is substantially linear and crosses the zero TC line 40 at about 4.5 volts as indicated by point 46. If it is desired for the voltage at output terminal 38 to be 7.15 volts, zener diode 30 can be chosen to have a voltage of 5.6 volts. The voltage at terminal 48 then must be 1.55 volts and have a negative TC of 1.5 millivolts per degree C. to compensate for the positive TC of 1.5 millivolts per degree C., as indicated by line 50 of FIG. 2. Under worst-case processing, the zener voltage may be 5.6±0.2 volts and the voltage at terminal 48 may be 1.55 volts±0.045 volts. Zener 30 may be implanted to decrease the voltage drift thereof.

If zener 30 was not utilized in circuit 10 then the resistive voltage divider would have to be arranged to facilitate the multiplication of the band gap voltage of 1.205 volts by about 6 to provide the desired 7.15 volts at terminal 38. This would also result in a multiplication of all temperature induced voltages at node 36 by about 6. Accordingly, the magnitude of the output voltage at terminal 38 could vary so much with temperature change that it could not meet the temperature specification for the MC1723, for example.

Emitter follower transistors 26, 27 28 and level shifting diode 31, in combination with current source 29 enable regulator or reference 10 to operate independently of line voltage variation. The emitters of transistors 24 and 25 tend to be at a voltage equal to the output voltage at terminal 38 plus the voltage across the base-to-emitter junction of transistor 28. Thus, the cell including transistors 12, 14, 24 and 25 is hooked to its own regulated output voltage. Consequently variations in the magnitude of the line voltage between conductors 16 and 18 are not applied to the cell. The cell provides a regulated voltage at the base of transistor 26 which is raised by the base-to-emitter junction voltage of transistor 26 and diode 31, and then lowered by the base-to-emitter junction voltage of transistor 27. Hence, transistor 25 has about zero volts collector-to-base. Constant current source 29 provides bias current for emitter-follower transistors 26 and 27 and diode 31.

What has been described is a novel, general-purpose voltage reference source 10 having a relatively simple configuration. A regulated output voltage is provided at terminal 38 which has a higher magnitude and which is relatively temperature independent as compared to prior art voltage reference circuits. The utilization of zener diode 30 in the negative feedback loop facilitates these advantages. Also, other temperature dependent devices or circuits can be utilized in the negative feedback loop.

We claim:

1. A voltage reference for providing an output voltage at an output terminal thereof having independently adjustable temperature coefficient and magnitude, wherein the magnitude of the output voltage is of a relatively high level, including in combination:

first and second transistors, each having emitter, base, and collector electrodes;

a negative feedback loop interconnecting said first and second transistors and the output terminal of the voltage reference, said feedback loop enabling the currents through said first and second transistors to have a predetermined non-unity ratio of current densities;

means connected to said emitter electrodes of said first and second transistors for developing a voltage having a positive temperature coefficient in response to said non-unity ratio of current densities; said voltage having said positive temperature coefficient combining with the emitter-to-base voltage of one of said first and second transistors to produce a combined voltage in said negative feedback loop having a predetermined variation with temperature; and further means coupled in said negative feedback loop providing a voltage having a predetermined variation with temperature which cooperates with said combined voltage to provide a reference voltage having a predetermined temperature coefficient at the output terminal of the voltage reference.

2. The voltage reference of claim 1 further including additional means connecting said base electrodes of said first and second transistors together so that equal base potentials are applied thereto.

3. The voltage reference of claim 1 further including current mirror means connected between said collector electrodes of said first and second transistors.

4. The voltage reference of claim 1 wherein said means includes a voltage divider means having two resistors with a junction therebetween, said two resistors being connected in series with said emitter electrode of one of said first and second transistors and said junction being connected to said emitter electrode of the other of said first and second transistors.

5. The voltage reference of claim 1 further including a voltage divider means coupled in said negative feedback loop and zener diode means coupled in series with said voltage divider means.

6. The voltage reference of claim 5 wherein said zener diode means includes an implanted zener diode.

7. A solid-state temperature-compensated voltage reference supply for providing a regulated voltage having a high magnitude, comprising:

first and second transistors each having emitter, base and collector electrodes;

resistive means connected between said emitter electrodes of said first and second transistors;

conductor means for furnishing supply potentials to said first and second transistors to develop current flow therethrough;

means for sensing the magnitudes of the respective currents flowing through said first and second transistors;

amplifier means coupled to said base electrodes of said first and second transistors and responsive to said means for sensing to adjust the base potentials of said transistors to maintain the magnitudes of said transistor currents at levels which provide a predetermined non-unity ratio of current densities within said first and second transistors to thereby cause the current through said resistive means to vary positively with respect to the temperature of said first and second transistors;

means for developing a first voltage proportional to said current of said resistive means and for combining said first voltage with a second voltage which varies negatively with temperature to produce a combined voltage having a predetermined variation with temperature;

a voltage-dividing network including a zener diode, said zener diode providing a third voltage having a further variation with temperature which substantially cancels said predetermined variation with temperature of said second voltage, said voltage-dividing network being coupled to the output terminal of said amplifier means and further having a network terminal providing a voltage reference which is a predetermined fraction of the output voltage of the amplifier means to enable said voltage reference supply to provide an output voltage having a high magnitude; and means coupling said network terminal to the base electrodes of said first and second transistors.

8. The voltage reference supply of claim 5, further including means connecting said base electrodes of said first and second transistors together to provide equal base potentials.

9. The solid state temperature compensated voltage reference supply of claim 7 wherein said zener diode includes an implanted zener diode.

10. A solid state temperature-compensated voltage supply for providing a regulated output voltage, comprising:

first and second transistors each having emitter, base and collector electrodes;

resistive means having first and second ends, said first end being connected to said emitter electrode of said first transistor, said second end being connected to said emitter electrode of said second transistor;

feedback means coupled between said collector electrodes and said base electrodes of said first and second transistors, said feedback means being responsive to said collector currents of said first and second transistors and operable to adjust the base potentials of said first and second transistors to maintain the magnitudes of the emitter currents of said first and second transistors at levels which provide a predetermined non-unity ratio of emitter current densities between said first and second transistors to thereby cause the current through said resistive means to vary positively with respect to the temperature of said first and second transistors;

circuit means for developing a first voltage proportional to said current through said resistive means and for combining said first voltage with a second voltage which varies negatively with respect to temperature to provide a combined voltage having a predetermined variation with respect to temperature; and further circuit means coupled to said circuit means, said further circuit means providing a third voltage having a further variation with temperature which substantially cancels said predetermined variation with temperature of said combined voltage, said further circuit means enabling the voltage supply to provide a temperature compensated regulated output voltage.

11. The voltage supply of claim 10 wherein said feedback means includes an amplifier and a voltage divider, and said further circuit means includes a zener diode coupled in series with said voltage divider.

12. The voltage supply of claim 11 wherein said zener diode includes an implanted zener diode.

* * * * *